US011154151B2

(12) United States Patent
Kucera

(10) Patent No.: US 11,154,151 B2
(45) Date of Patent: Oct. 26, 2021

(54) HANGING DRESSING AID

(71) Applicant: Jaroslav Kucera, Moravska Nova Ves (CZ)

(72) Inventor: Jaroslav Kucera, Moravska Nova Ves (CZ)

( * ) Notice: Subject to any disclaimer, the term of this patent is extended or adjusted under 35 U.S.C. 154(b) by 143 days.

(21) Appl. No.: 16/578,540

(22) Filed: Sep. 23, 2019

(65) Prior Publication Data

US 2021/0085113 A1 Mar. 25, 2021

(51) Int. Cl.
*A47G 25/90* (2006.01)

(52) U.S. Cl.
CPC ..... *A47G 25/90* (2013.01)

(58) Field of Classification Search
CPC ..... A47G 25/90; A47G 25/14; A47G 25/0671
See application file for complete search history.

(56) References Cited

U.S. PATENT DOCUMENTS 384,769 A * 6/1888 Lacourse ..... A47G 25/746 211/85.3
462,380 A * 11/1891 Gruendler ..... A47G 25/90
609,427 A * 8/1898 Griffith
612,623 A * 10/1898 Benesh ..... A47G 25/0671 211/85.3
658,801 A * 10/1900 Platt ..... A47G 25/80
738,575 A * 9/1903 Seitz ..... A47G 25/90
975,246 A * 11/1910 Johnson
1,011,463 A * 12/1911 Martin ..... A47G 25/486 223/93
1,687,129 A * 10/1928 Henninger ..... A47G 25/746 211/85.3
5,501,376 A 3/1996 Roda-Balzarini
9,445,680 B2 * 9/2016 Bean ..... A47G 25/80
2011/0036794 A1 * 2/2011 Schott ..... A47G 25/0671 211/85.3
2012/0223109 A1 9/2012 Wheeler, Sr.
2016/0286997 A1 * 10/2016 Mcbroom ..... A47G 25/90
2017/0013986 A1 1/2017 Bassetti
2017/0035231 A1 * 2/2017 Miels ..... A47G 25/90

FOREIGN PATENT DOCUMENTS

CN 203326472 U 12/2013
CN 204797473 U 11/2015
EP 1 358 629 A1 11/2003
GB 101444 3/1917
WO WO 03/051161 A1 6/2003

* cited by examiner

*Primary Examiner* — Ismael Izaguirre
(74) *Attorney, Agent, or Firm* — Blank Rome LLP

(57) ABSTRACT

A hanging dressing aid device for upper body for putting on pull-over or button-up garments, designed in particular for persons with limited mobility of upper musculoskeletal system. The hanging dressing aid comprises a base to which the body of the dressing aid is attached, provided with top rounded continuous parts lying in one plane, serving as dressing aid arms. The body can be folded and attached to the base using an interlocking element. Between the continuous parts, a part is placed on the body of the dressing aid allowing garments to be donned over the head. The plane, in which the continuous parts of the dressing aid lie, forms an angle of less than 90° from the upper part of the plane of the base.

13 Claims, 3 Drawing Sheets

HANGING DRESSING AID

FIELD OF THE INVENTION

The invention pertains to a hanging dressing aid device such as for upper body designed in particular for persons with limited mobility of upper musculoskeletal system.

BACKGROUND

Persons with limited mobility face numerous obstacles in their everyday life on a daily basis, and often need the help of another person. Of great benefit for these persons are therefore aids which at least partially facilitate activities that are otherwise difficult for people with limited mobility. These include, but are not limited to, putting on upper body garments, sweaters, shirts, coats, jackets, t-shirts, and the like that require a lot of movements, posing a particular problem for people after surgery of upper musculoskeletal system who cannot lift their arms sufficiently high, or people with limited mobility, who often cannot do without the help of other persons.

SUMMARY

The above drawback is obviated by a hanging dressing aid device according to the present invention, such as an aid for putting on pull-over or button-up garments for the upper body.

The hanging dressing aid comprises a base to which the body of the dressing aid is attached, provided on the sides with top rounded continuous parts lying in one plane, serving as dressing aid arms for attaching the upper parts of the sleeves. The continuous parts may be interconnected by an element allowing to change their span.

Between the continuous parts, a part is placed vertically on the body of the dressing aid in a sliding mounting, allowing garments to be donned over the head. At its upper end, the part is provided with a retaining element bent towards the continuous parts and a flat rounded guiding part bent away from the continuous parts. The plane, in which the continuous parts of the dressing aid lie, forms an angle $\alpha$ of less than 90° from the top of the plane of the base. The upper part of the front side of the base and the rear side of the body of the dressing aid are provided with counterparts of an interlocking element allowing the dressing aid body to be attached to the base.

The body of the dressing aid is fixed to the base by at least one fastening element in which an anchoring element is anchored by a locking mechanism. The locking mechanism allows the anchoring element to be kept in at least one position in the fastening element.

The locking mechanism may comprise a bar with a pin hole, which is concurrently anchoring the body of the dressing aid in the fastening element on the base and also allowing to set an angle $\alpha$ of the plane in which the continuous parts of the dressing aid are located relative to the base. The bar is provided with a stop element which secures the position of the body of the dressing aid at an angle suitable for putting on clothes, and prevents the body from falling to the vertical position in case of failure of the locking mechanism.

According to another embodiment, the anchoring element may comprise a slider anchored in at least one vertical groove blinded at the lower end, located in the fastening element connected to the base. The groove preferably comprises at least three positions for setting the anchoring element in the fastener by the locking mechanism.

The anchoring element is connected to the body of the dressing aid by a mechanism for adjusting the angle $\alpha$. The plane in which the continuous parts of the dressing aid are placed preferably forms an angle $\alpha$ of 40° to 50° from the upper part of the plane of the base. The adjustment mechanism for the angle $\alpha$ can be of any type; it may comprise, for example, a clamping screw with a wing nut. The adjustment mechanism for setting the angle $\alpha$ also fixes the body of the dressing aid in a certain position, preventing it from spontaneously collapsing to the base.

The hanging dressing aid according to the claims can be made of any material, preferably plastic, wood or metal, or a combination of these materials. If it is made of plastic, each of the continuous parts of the dressing aid is provided with at least one opening.

The dressing aid may be mounted on a wall and may be provided with a sliding mechanism on the back of the base allowing vertical movement on the wall to change the height of the dressing aid as desired by the wearer, or the base may comprise an element allowing the dressing aid to be hung on another solid support.

The base is preferably a panel of any shape, which may be provided with other elements, for example, for hanging clothes or with a decorative. According to an embodiment of the present invention, it is provided with a hook in the lower part for storing a part allowing garments to be donned over the head, when the part is not needed. The continuous parts serving as arms of the dressing aid may be flat or may have any shape in vertical cross-section, for example, half-round, round, hexagonal, octagonal or other geometric or decorative shape. Counterparts of the interlocking element allow the body of the dressing aid to be attached to the base and thereby folded into a collapsed position for transport or storage.

The embodiment of the dressing aid according to the invention provides the possibility of adjusting the hanging height of the dressing aid as desired, also by changing the height of the suspension on the wall by a sliding mechanism on the base on which the dressing aid is anchored depending on the height of the wearer; the slant and span of its arms can be adapted to the stature of the wearer, and can be easily adjusted by the wearer as required.

An unfastened garment is to be hung up facing the dressing aid on the rounded continuous parts forming the arms of the dressing aid, and the wearer can then easily put it on directly from the hanging dressing aid without the help of another person. The wearer can easily don non-opening garments using a vertically sliding element on the body of the dressing aid, allowing donning pull-over garments. The garment head opening is pulled onto the rounded guiding part, and by grasping the lower end of the part and pulling it upwardly, the guiding part of the element, which, during pulling the garment on, follows the rounding of the wearer's head, pulls the garment over the head. The part for pulling garments over the head can be of any length; the shape, size and rounding of the guiding part of the element can be adapted to the shape of the wearer's head.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawing figures.

Below, the invention is explained in more detail vi exemplary embodiments, without however limiting other suitable embodiments within the scope of the claims.

DETAILED DESCRIPTION OF THE EXEMPLARY EMBODIMENTS

Example 1

Figure 1:
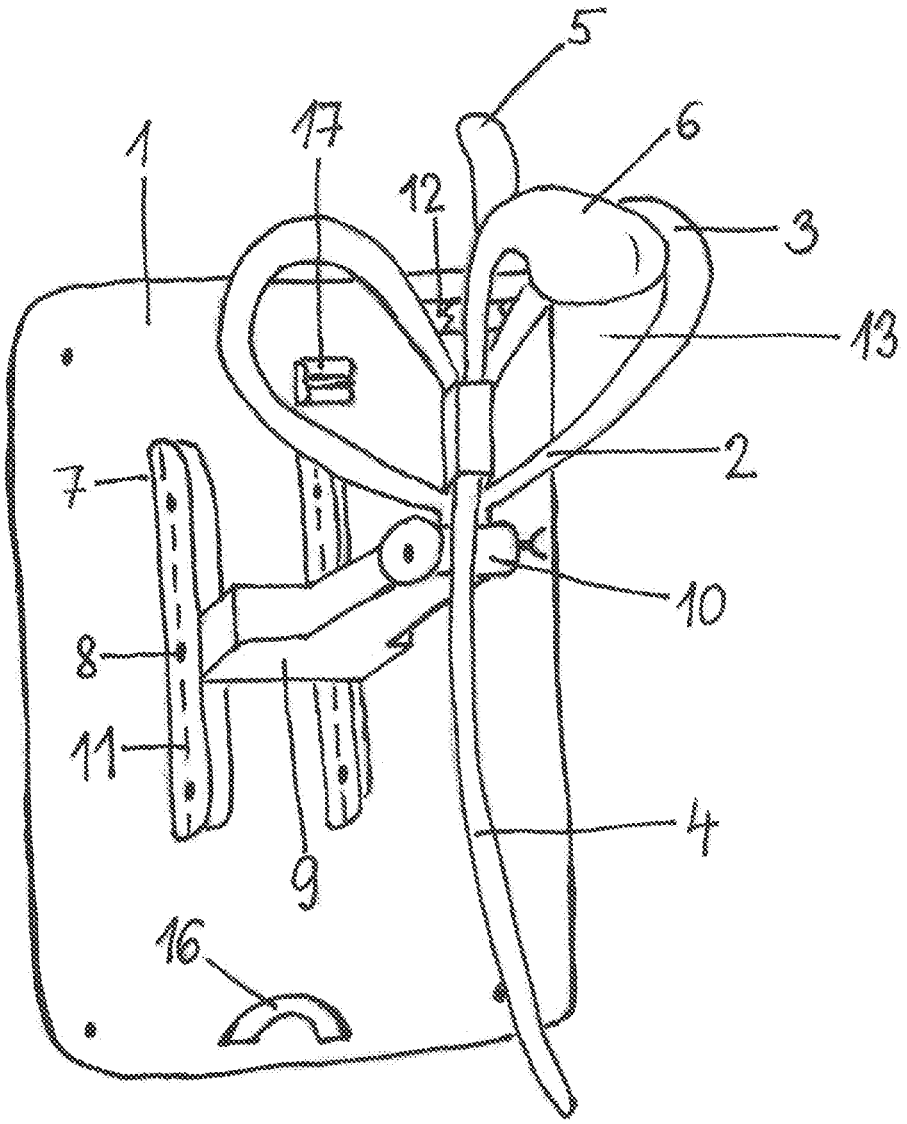
FIG. 1: A perspective view of an embodiment of a hanging dressing aid for the upper body and individual parts of the front of the dressing aid.
Figure 2:
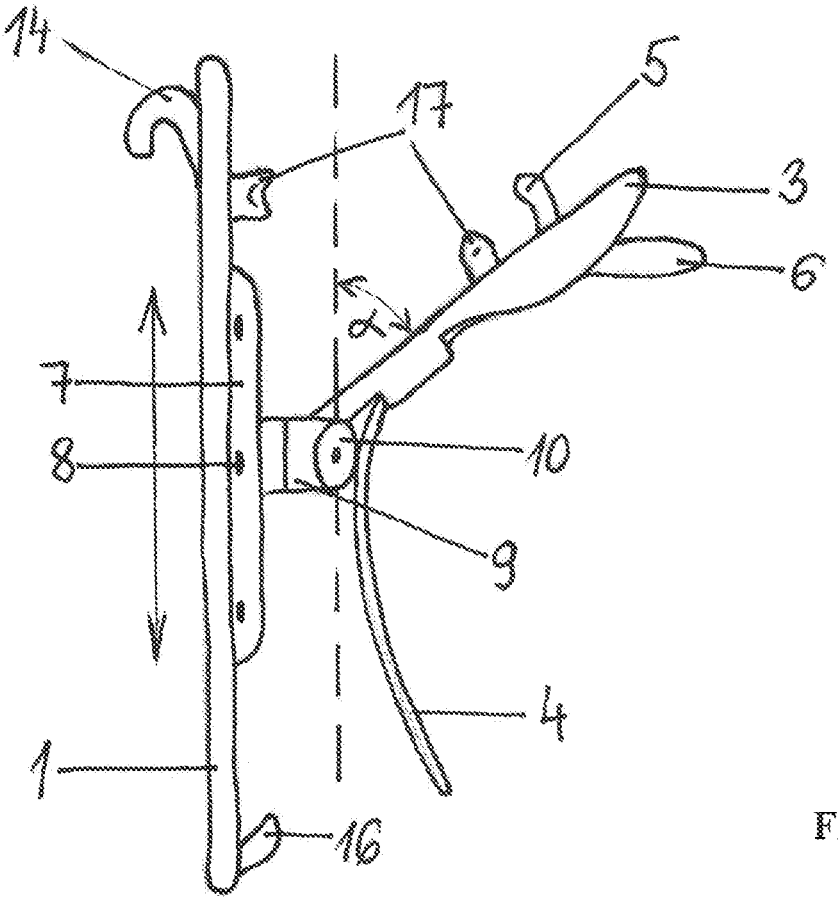
FIG. 2: A side view of an embodiment of the hanging dressing aid, where the tilt of the dressing aid body from the base at an angle α and the location of the counterparts of the interlocking element on the base and on the body of the dressing aid are visible.

The wall-mounted dressing aid device according to the invention made of plastic (FIG. 1) consists of a base 1 in the form of a rectangular panel adapted for wall mounting, to which the dressing aid body 2 is mounted provided with two top rounded continuous parts 3 lying in one plane forming continuous arcs serving as arms of the dressing aid. The parts 3 are flat on the back and semicircular on the front (FIG. 2). Each of the parts is provided with an opening 13. The continuous parts 3 are connected to each other by an element 12 allowing to change the span of the continuous parts 3 (arms) according to the wearer's needs. Between the dressing aid parts 3, a part 4 is placed on the body 2, allowing garments to be pulled over the head, in a mounting permitting bidirectional vertical movement of the part 4. The part 4 is detachably connected to the body 2; at its upper end it is provided with a retaining element 5 bent towards the continuous parts 3, and a flat rounded guiding part 6 bent away from the continuous parts 3. The body 2 of the dressing aid is connected to the base 1 by two fastening elements 7. In each fastening element 7, a vertical groove 11 is made. The grooves 11 accommodate an anchoring element 9 in the form of a slider. The grooves 11 are blinded at the lower end. The slider can be fixed in three positions in the groove 11 using the locking mechanism 8 to adjust the height of the body 2 of the wall-mounted dressing aid from the ground according to the wearer's needs. The dressing aid body 2 is connected to the anchoring element 9 by a mechanism 10 for adjusting the tilt of the plane of the dressing aid body 2 at an angle α from the plane of the upper part of the base 1 (FIG. 2). The position of the continuous dressing aid parts 3 at an angle α from the top of the base 1 is secured by a screw and a wing nut. The angle α formed by the plane of the continuous parts 3 and the base 1 is set to 50°. The upper part of the front side of the base 1 and the rear side of the body 2 of the dressing aid are provided with counterparts of the interlocking element 17 allowing the body 2 of the dressing aid to be attached to the base 1 and thereby folded into a collapsed position for transport or storage (FIG. 2). At the top of the back of the base 1, the dressing aid is provided with an element 14 enabling it to be hung up on a fixed support. In the lower part of the front of the base 1, the dressing aid is provided with a hook 16 for storing the part 4 allowing pulling garments over the head, when not in use (FIG. 1).

Example 2

Figure 4:
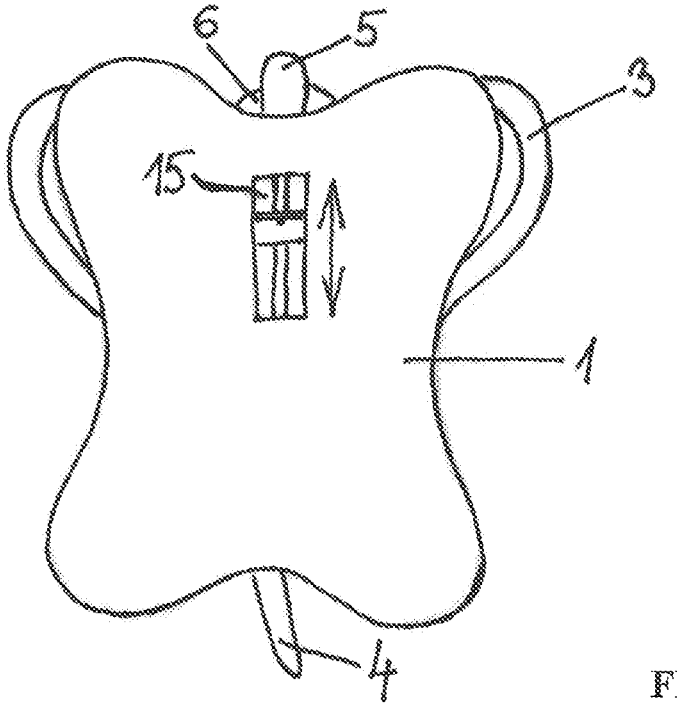
FIG. 4: A view from the rear side of the dressing aid in an embodiment where the base is provided with a sliding mechanism allowing vertical movement on the hanging surface.

The wall-mounted dressing aid according to the invention made of wood in combination with metal consists of a base 1 adapted for wall mounting in the form of a decorative shaped wooden panel, provided with a sliding mechanism 15 at the back allowing vertical movement of the base 1 on the wall (FIG. 4). Attached to the base 1 is the dressing aid body 2 provided with two top-rounded continuous panels 3 made of wood, lying in one plane, and forming continuous arches serving as dressing aid arms. Between the dressing aid parts 3, a part 4 made of metal is placed on the body 2 allowing garments to be pulled over the head, secured in a mounting permitting bidirectional vertical movement of the part 4. The part 4 is provided with a retaining element 5 at its upper end bent towards the continuous parts 3, and a flat rounded guiding part 6 bent away from the continuous parts 3. The upper part of the front side of the base 1 and the rear side of the body 2 of the dressing aid are provided with counterparts of an interlocking element 17 allowing the dressing aid body 2 to be firmly attached to the base 1 (folded) in a collapsed position to facilitate storage or transport of the dressing aid. The body 2 of the dressing aid is connected to the base 1 by two fastening elements 7. A vertical groove 11 is made in each fastening element 7. The grooves 11 accommodate an anchoring element 9 in the form of a slider. The grooves 11 are blinded at the lower end. The slider can be fixed in four positions in the groove 11 using the locking mechanism 8 to adjust the height of the body 2 of the wall-mounted dressing aid from the ground according to the wearer's needs. The dressing aid body 2 is connected to the anchoring element 9 by a mechanism 10 for adjusting an angle α of the plane of the upper part of the base 1, in which the continuous parts 3 of the dressing aid lie. At the same time, the angle adjusting mechanism 10 prevents the body 2 of the dressing aid from spontaneously collapsing to the base the base 1. The position of the continuous dressing aid parts 3 at an angle α from the top of the base 1 is secured by a screw and a wing nut. The angle α formed by the plane of the continuous parts 3 and the base 1 is set to 45°. In the lower part of the front of the base 1, the dressing aid is provided with a hook 16 for storing the part 4 allowing pulling garments over the head, when not in use.

Example 3

Figure 3:
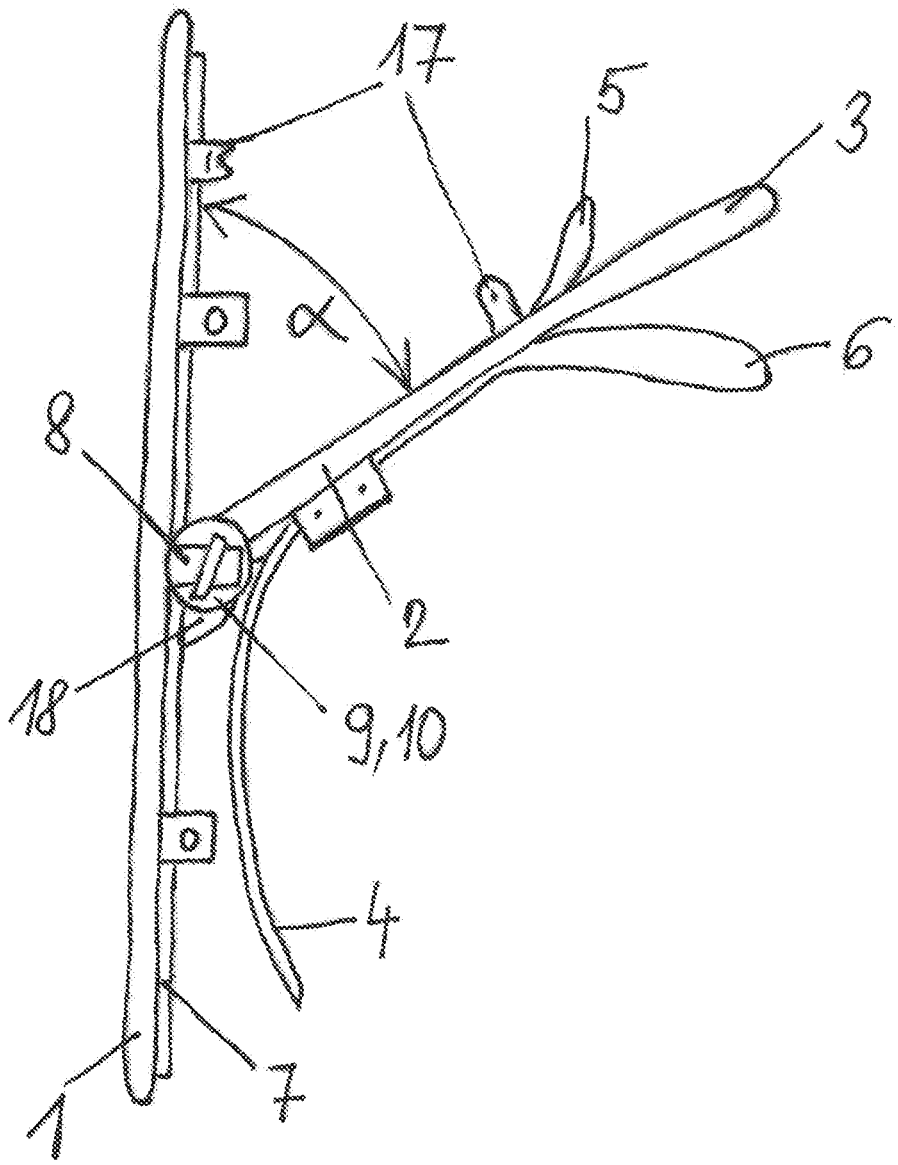
FIG. 3: A side view of an embodiment of the hanging dressing aid, wherein the locking mechanism comprises a bar fixed by a pin forming an anchoring element which is provided with a stop element.

The wall-mounted dressing aid according to the invention made of wood in combination with metal consists of a base 1 adapted for wall mounting in the form of a decorative shaped wooden panel. Attached to the base 1 is the dressing aid body 2 provided with two top-rounded continuous parts 3 made of wood lying in one plane, and forming continuous arches serving as arms of the dressing aid. Between the dressing aid parts 3, a part 4 made of metal is placed on the body 2 allowing garments to be pulled over the head, secured in a mounting permitting bidirectional vertical movement of the part 4. The part 4 is provided with a retaining element 5 at its upper end, bent towards the continuous parts 3 and a flat rounded guiding part 6 bent away from the continuous parts 3. The upper part of the front side of the base 1 and the rear side of the body 2 of the dressing aid are provided with counterparts of an interlocking element 17 allowing the dressing aid body to be firmly attached to the base 1 (folded) in a collapsed position to facilitate storage or transport of the dressing aid. The body 2 of the dressing aid is connected to the base 1 by of a fastening element 7. The fastening element is a vertical metal plate attached to the base 1, provided in three positions with a pair of opposite metal projections comprising an opening. (FIG. 3). The dressing aid body 2 is attached to the fastening element 7 by an anchoring element 9, which is a bar with a pin hole forming part of the dressing aid body locking mechanism 8, maintaining a certain position on the fastening element 7 by projections with openings therein. The bar with a pin is also a mechanism 10 for adjusting the angle α of the plane in which the continuous parts 3 of the dressing aid lie at 40° with respect to the plane of the base. The bar is provided with a stop element 18 abutting the metal plate of the fastening element 7. The stop element 18 secures the position of the dressing aid body at an angle suitable for putting clothes on, and prevents the body 2 from collapsing to the vertical position in case of failure of the locking mechanism 8.

The wall-mounted dressing aid device according to the invention provides persons with limited mobility of upper limbs with a simple, stable, comfortable and practical aid for putting on pull-over or button-up upper body garments without the help of another person. By adjusting the height and tilt of the arms from the wall on which it is suspended, it can be easily adapted to people of different stature. The dressing aid has a simple, easy-to-store and easy-to-carry design, and it is not demanding in terms of production from a technical or financial point of view.

While particular embodiments have been chosen to illustrate the invention, it will be understood by those skilled in the art that various changes and modifications can be made therein without departing from the scope of the invention as defined in the appended claims.

LIST OF REFERENCE MARKS

1—Base
2—Dressing aid body
3—Continuous parts forming the arms
4—Part allowing garments to be pulled over the head
5—Retaining element
6—Rounded guiding part
7—Fastening element
8—Locking mechanism
9—Anchoring element
10—Mechanism for adjusting the angle α
11—Groove
12—Element allowing to change the span of the panel parts
13—Opening in the continuous part
14—Hanging element for hanging the dressing aid
15—Sliding mechanisms on the base
16—Hook
17—Counterpart of the interlocking element
18—Stop element

What is claimed is:

1. A hanging dressing aid, comprising:

a base to which a dressing aid body, provided with top rounded continuous parts lying in one plane, is attached, wherein the continuous parts are interconnected by an element allowing to change the span of the continuous parts, wherein a part is placed between the continuous parts on the body of the dressing aid in a sliding mounting in a bidirectional vertical direction, for donning garments over the head, wherein said part comprises a retaining element at its an upper end bent towards the continuous parts and a rounded guiding part bent away from the continuous parts, and the plane in which the continuous parts of the dressing aid lie forms an angle α of less than 90° from an upper part of a plane of the base, wherein the dressing aid body is attached to the base by at least one fastening element provided with at least one locking mechanism, wherein the body of the dressing aid is anchored in the locking mechanism by an anchoring element, and the upper part of a front of the base and a rear part of the body of the dressing aid are provided with counterparts of an interlocking element.

2. A hanging dressing aid according to claim 1, characterized in that the locking mechanism comprises a bar with a pin hole, which is concurrently an anchoring element, and a mechanism for setting the angle α, wherein the bar is provided with a stop element.

3. A hanging dressing aid according to claim 1, characterized in that the anchoring element is provided with a mechanism for setting the angle α.

4. A hanging dressing aid according to claim 3, characterized in that the mechanism for setting the angle α comprises a clamping screw with a wing nut.

5. A hanging dressing aid according to claim 3, characterized in that the anchoring element comprises a slider anchored by the locking mechanism in at least one vertical groove blinded at the lower end and located in the fastening element connected to the base.

6. A hanging dressing aid according to claim 1, characterized in that the plane in which the continuous parts of the dressing aid are placed form an angle α of 40° to 50° from the upper part of the plane of the base.

7. A hanging dressing aid according to claim 1, characterized in that the base is provided with an element for hanging the dressing aid.

8. A hanging dressing aid according to claim 1, characterized in that the base is provided with a sliding mechanism on the back of the base allowing vertical movement on the hanging surface.

9. A hanging dressing aid according to claim 1, characterized in that the base is provided with a hook at the bottom of the front part for storing the part.

10. A hanging dressing aid according to claim 1, characterized in that it is made of plastic.

11. A hanging dressing aid according to claim 10, characterized in that each of the continuous parts is provided with at least one opening.

12. A hanging dressing aid, comprising:

a base to which a dressing aid body, provided with top rounded continuous parts lying in one plane, is attached, wherein a part is placed between the continuous parts on the body of the dressing aid in a sliding mounting in a bidirectional vertical direction, for donning garments over the head, wherein said part comprises a retaining element at an upper end that is bent towards the continuous parts and a rounded guiding part that is bent away from the continuous parts, and the plane in which the continuous parts of the dressing aid lie forms an angle α of less than 90° from an upper part of a plane of the base, wherein the dressing aid body is attached to the base by at least one fastening element provided with at least one locking mechanism, wherein the body of the dressing aid is anchored in the locking mechanism by an anchoring element, wherein the anchoring element is provided with a mechanism for setting the angle α, and the upper part of a front of the base and a rear part of the body of the dressing aid are provided with counterparts of an interlocking element.

13. A hanging dressing aid, comprising:

a base to which a dressing aid body, provided with top rounded continuous parts lying in one plane, is attached, wherein a part is placed between the continuous parts on the body of the dressing aid in a sliding mounting in a bidirectional vertical direction, for donning garments over the head, wherein said part comprises a retaining element at an upper end that is bent towards the continuous parts and a rounded guiding part that is bent away from the continuous parts, and the plane in which the continuous parts of the dressing aid lie forms an angle $\alpha$ of less than 90° from an upper part of a plane of the base, wherein the dressing aid body is attached to the base by at least one fastening element provided with at least one locking mechanism, wherein the body of the dressing aid is anchored in the locking mechanism by an anchoring element, and the upper part of a front of the base and a rear part of the body of the dressing aid are provided with counterparts of an interlocking element, and wherein the base is provided with a sliding mechanism on the back of the base allowing vertical movement on the hanging surface.

* * * * *